US009142171B2

(12) United States Patent
Park

(10) Patent No.: US 9,142,171 B2
(45) Date of Patent: Sep. 22, 2015

(54) DISPLAY DEVICE AND METHOD OF DRIVING THEREOF

(75) Inventor: Moon-Chul Park, Yongin (KR)

(73) Assignee: Samsung Dsiplay Co., Ltd., Gyeonggi-Do (KR)

( * ) Notice: Subject to any disclaimer, the term of this patent is extended or adjusted under 35 U.S.C. 154(b) by 383 days.

(21) Appl. No.: 13/085,364

(22) Filed: Apr. 12, 2011

(65) Prior Publication Data

US 2011/0292017 A1 Dec. 1, 2011

(30) Foreign Application Priority Data

May 25, 2010 (KR) ..... 10-2010-0048734

(51) Int. Cl.
*G09G 5/00* (2006.01)
*G09G 3/36* (2006.01)

(52) U.S. Cl.
CPC ..... *G09G 3/3611* (2013.01); *G09G 2300/0426* (2013.01); *G09G 2310/0232* (2013.01); *G09G 2320/041* (2013.01); *G09G 2320/046* (2013.01); *G09G 2330/02* (2013.01)

(58) Field of Classification Search
CPC ..... G09G 2300/0426; G09G 2310/0232; G09G 2320/041; G09G 2320/046; G09G 2330/02; G09G 3/3611
USPC ..... 345/96, 211, 87, 92, 98, 100, 94
See application file for complete search history.

(56) References Cited

U.S. PATENT DOCUMENTS

| | | | | |
|---|---|---|---|---|
| 2002/0021271 | A1* | 2/2002 | Sakamoto | 345/87 |
| 2007/0001963 | A1* | 1/2007 | Koma | 345/96 |
| 2007/0008274 | A1* | 1/2007 | Nakanishi et al. | 345/101 |
| 2007/0070003 | A1* | 3/2007 | Nakamura et al. | 345/87 |
| 2007/0085960 | A1* | 4/2007 | Kim | 349/149 |
| 2008/0018634 | A1* | 1/2008 | Yeo et al. | 345/210 |
| 2008/0158493 | A1* | 7/2008 | Park | 349/139 |
| 2010/0001988 | A1* | 1/2010 | Kim | 345/214 |
| 2010/0039364 | A1* | 2/2010 | Lee | 345/100 |
| 2010/0220087 | A1* | 9/2010 | Nachbaur et al. | 345/211 |
| 2011/0193844 | A1* | 8/2011 | Lee et al. | 345/211 |

FOREIGN PATENT DOCUMENTS

| | | | |
|---|---|---|---|
| JP | 9-54325 | A | 2/1997 |
| JP | 10-268358 | A | 10/1998 |
| JP | 2008-170686 | A | 7/2008 |
| KR | 2002-0058715 | A | 7/2002 |
| KR | 10-2007-0075796 | A | 7/2007 |
| KR | 10-2007-0078466 | A | 8/2007 |

OTHER PUBLICATIONS

Korean Office Action dated Aug. 8, 2011 for Korean Patent Application No. KR 10-2010-0048734 which corresponds to captioned U.S. Appl. No. 13/085,364.

* cited by examiner

*Primary Examiner* — Quan-Zhen Wang
*Assistant Examiner* — Tony Davis
(74) *Attorney, Agent, or Firm* — Knobbe Martens Olson & Bear LLP

(57) ABSTRACT

A display is disclosed. The display includes electrodes in an edge region of the panels to which AC voltages are applied to reduce the effects of ionic particles.

17 Claims, 7 Drawing Sheets

DISPLAY DEVICE AND METHOD OF DRIVING THEREOF

CROSS-REFERENCE TO RELATED APPLICATIONS

This application claims priority to and the benefit of Korean Patent Application No. 10-2010-0048734 filed in the Korean Intellectual Property Office on May 25, 2010, the entire contents of which are incorporated herein by reference.

BACKGROUND

1. Field

The technology relates to a display device and a driving method thereof. More particularly, the technology relates to a display device and a driving method thereof which has better quality on the edges of the display device at a high temperature.

2. Description of the Related Technology

As a representative flat panel display device, a liquid crystal display (LCD) includes two display panels with pixel electrodes and a common electrode, and a liquid crystal layer having an anisotropic dielectric interposed between the two panels. The pixel electrodes are arranged in a matrix and are connected to switches such as thin film transistors (TFT) to sequentially receive a data voltage by row. The common electrode is formed over the entire surface of the display panel to receive a common voltage. The pixel electrodes, the common electrode, and the liquid crystal layer interposed between the pixel electrodes and the common electrode form a liquid crystal capacitor, and the liquid crystal capacitor and a switch connected thereto are a basic unit forming a pixel.

In an LCD, an electric field is generated in the liquid crystal layer by applying voltages to the two electrodes, and transmittance of light passing through the liquid crystal layer of each of the pixels is controlled by controlling the electric fields to display a desired image. In order to prevent degradation of the display caused by a lengthy application of an electric field in one direction to a liquid crystal layer, polarity of the data voltage with respect to the common voltage is inverted for respective frames, respective rows, or respective pixels.

A common electrode panel including the common electrode and a thin film transistor array panel including the pixel electrode are fixed by a sealant formed on the edge thereof. Ionic particles may be generated by the sealant because of heat generated during the sealing operation, during the lifetime of the display device, or heat generated in the external environment. The ionic particles are generally around the outer edge of the display and have a certain charge polarity because of the voltage applied to the common electrode and the pixel electrode. Because of the charge, the particles are fixed to the common electrode and the pixel electrode on the edge of the display device such that a residual DC voltage is generated. The threshold of the liquid crystal is altered by the residual DC voltage and visual artifacts may thereby be formed on the edge of the display device.

The above information disclosed in this Background section is only for enhancement of understanding of the background and therefore it may contain information that does not form the prior art that is already known in this country to a person of ordinary skill in the art.

SUMMARY OF CERTAIN INVENTIVE ASPECTS

One inventive aspect is a display device. The display device includes a liquid crystal panel assembly including a thin film transistor array panel and a common electrode panel facing each other. The display also includes an AC electrode formed in an edge region of the common electrode panel and applied with an AC voltage, a reference electrode formed on the thin film transistor array panel opposite the AC electrode and applied with a common voltage, an AC voltage generator configured to generate the AC voltage and to transmit the AC voltage to the AC electrode, and a signal controller configured to transmit a control signal to the AC voltage generator. The control signal is generated when a temperature of the edge region is higher than a threshold temperature, and the AC voltage generator generates the AC voltage based on the control signal.

Another inventive aspect is a method of driving a display device. The display device has an AC voltage generator applying an AC voltage to an AC electrode formed in an edge region in a display panel, which includes a display area and an edge region. The method includes receiving an application start signal, in response to the application start signal, applying a first gate signal to a high voltage switching transistor configured to apply a +AVDD voltage to the AC electrode, and applying a second gate signal to a low voltage switching transistor configured to apply a −AVDD voltage to the AC electrode. In addition, the AC voltage generator alternately transmits the first gate signal and the second gate signal in a predetermined period.

DETAILED DESCRIPTION OF CERTAIN INVENTIVE EMBODIMENTS

Figure 1:
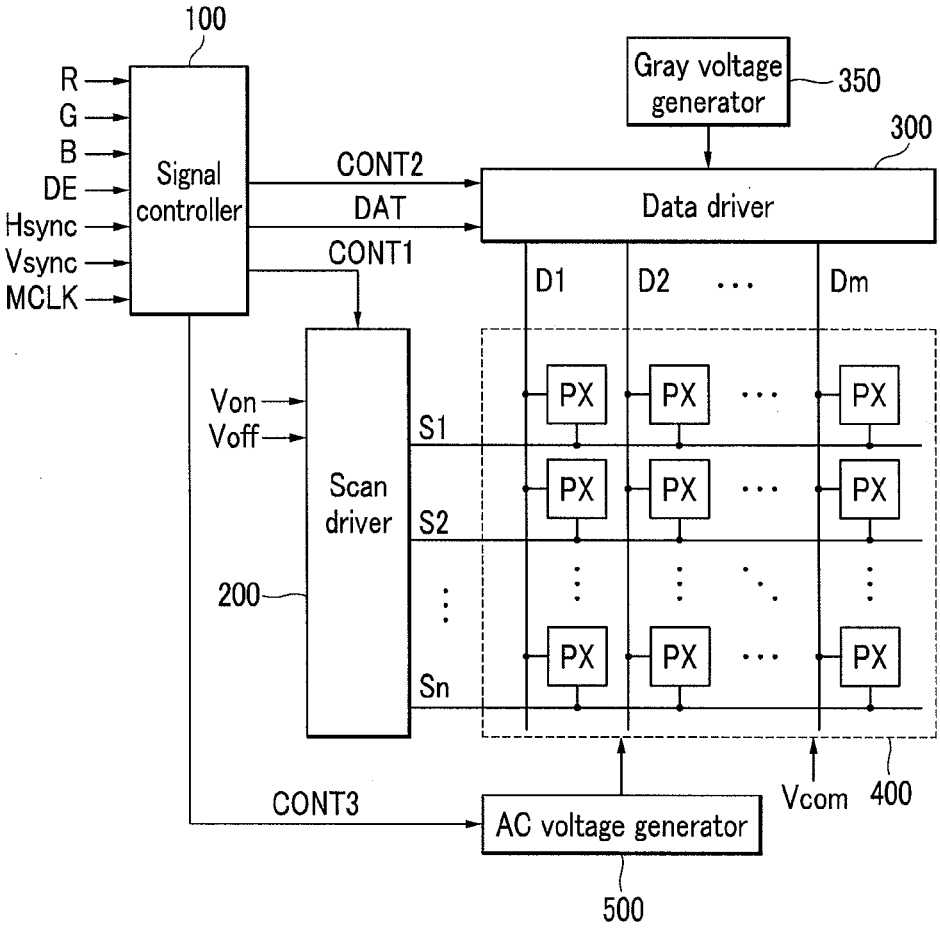
FIG. 1 is a block diagram of a liquid crystal display (LCD) according to an exemplary embodiment.

The present invention will be described more fully hereinafter with reference to the accompanying drawings, in which exemplary embodiments are shown. As those skilled in the art would realize, the described embodiments may be modified in various ways.

Further, in the embodiments, like reference numerals generally designate like elements throughout the specification.

The drawings and description are to be regarded as illustrative in nature and not restrictive.

In some cases, when an element is described as being "coupled" to another element, the element may be "directly coupled" to the other element or "electrically coupled" to the other element through a third element. In addition, unless explicitly described to the contrary, the word "comprise" and variations such as "comprises" or "comprising" will be understood to imply the inclusion of stated elements but not the exclusion of any other elements.

Structure and function of a liquid crystal display (LCD) according to an exemplary embodiment are described with reference to FIGS. 1 to 5. The principles and aspects described may also be applied to other types of displays.

Figure 2:
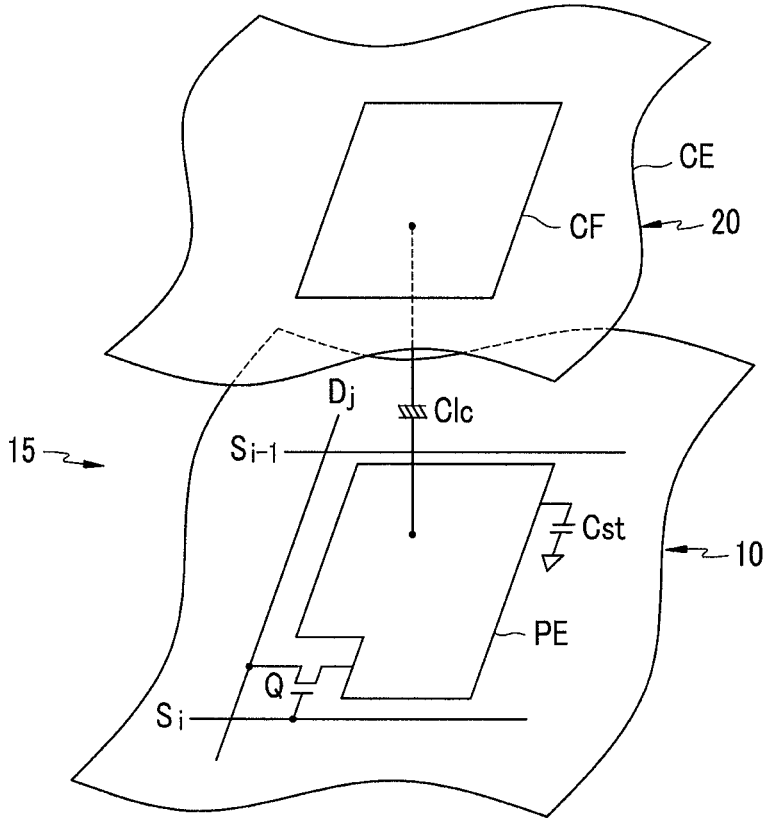
FIG. 2 is a schematic diagram of one pixel of FIG. 1.
Figure 3:
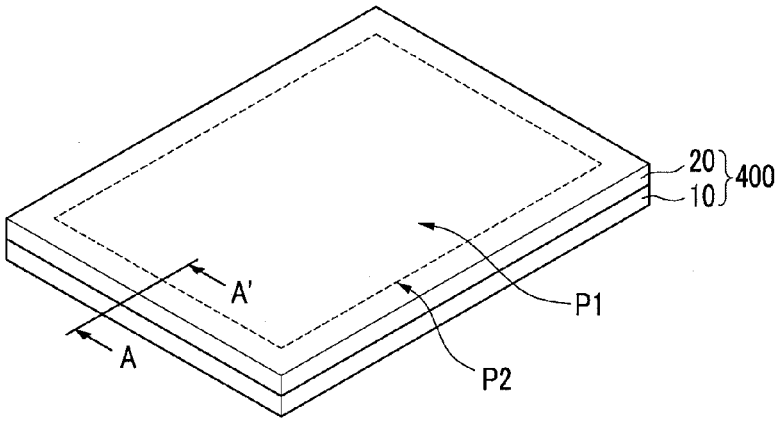
FIG. 3 is a perspective view of the liquid crystal display (LCD) shown in FIG. 1.
Figure 4:
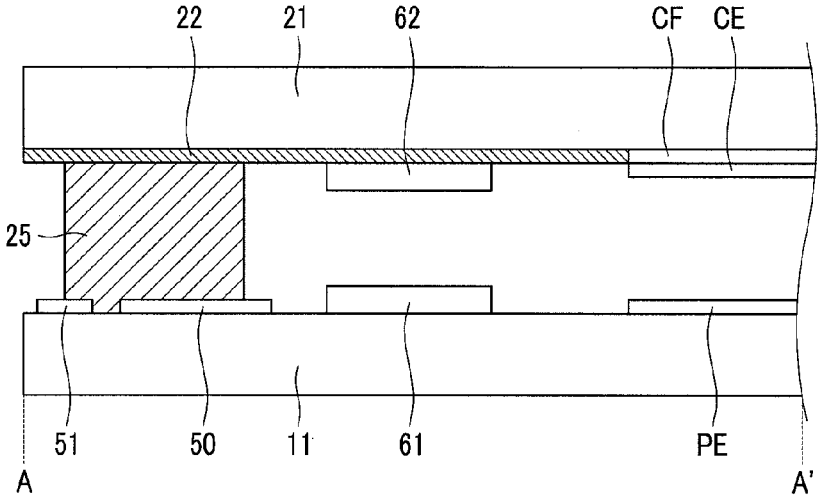
FIG. 4 is a cross-sectional view taken along the line A-A' of FIG. 3.
Figure 5:
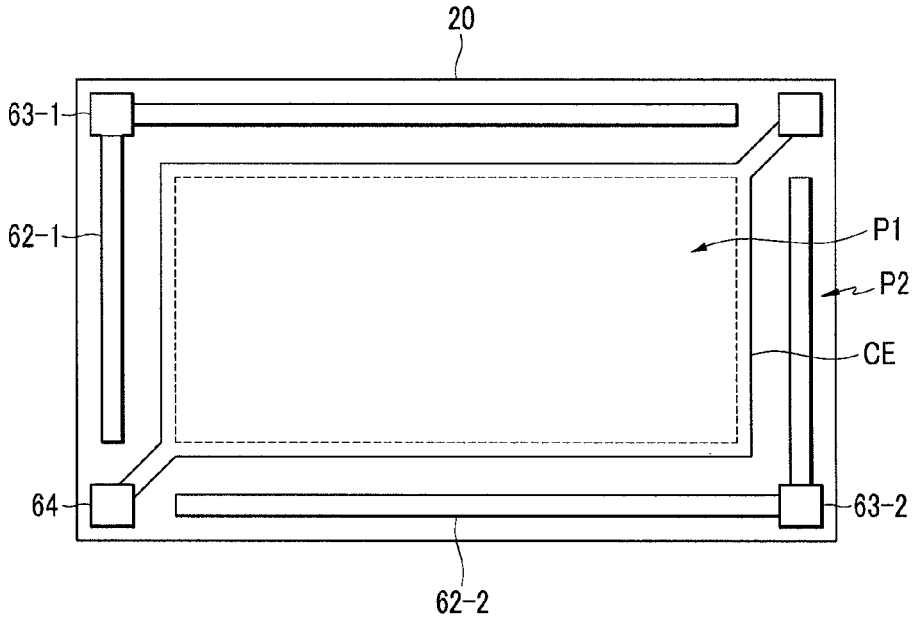
FIG. 5 is a plan view showing a common electrode panel in the liquid crystal display (LCD) shown in FIG. 1.

FIG. 1 is a block diagram of a liquid crystal display (LCD) according to an exemplary embodiment. FIG. 2 is a schematic diagram of one pixel of FIG. 1. FIG. 3 is a perspective view of the liquid crystal display (LCD) shown in FIG. 1. FIG. 4 is a cross-sectional view taken along the line A-A' of FIG. 3. FIG. 5 is a view showing a common electrode panel in the liquid crystal display (LCD) shown in FIG. 1.

Referring to FIG. 1, a liquid crystal display (LCD) includes a liquid crystal panel assembly 400, a scan driver 200, a data driver 300, an AC voltage generator 500, a gray voltage generator 350 connected to the data driver 300, and a signal controller 100 controlling the drivers 200 and 300.

The liquid crystal panel assembly 400 includes a plurality of scan lines S1-Sn, a plurality of data lines D1-Dm, and a plurality of pixels PX connected to the plurality of signal lines S1-Sn and D1-Dm and generally arranged in a matrix.

The scan lines S1 to Sn generally extend in a row direction and are substantially parallel to each other. The data lines D1 to Dm generally extend in a column direction and are substantially parallel to each other. At least one polarizer (not shown) for polarizing light may be attached on an outer surface of the liquid crystal panel assembly 400.

The plurality of scan lines S1-Sn are connected to the scan driver 200, and the plurality of data lines D1-Dm are connected to the data driver 300.

Each of the above-mentioned driving apparatus 100, 200, 300, 350, and 500 may be directly mounted on the liquid crystal display panel assembly 300 in the form of at least one IC chip, may be mounted on a flexible printed circuit film (not shown) and then mounted on the liquid crystal panel assembly 300 in the form of a tape carrier package (TCP), or may be mounted on a separate printed circuit board (not shown). Alternatively, the drivers 100, 200, 300, 350, and 500 may be integrated with the liquid crystal display panel assembly 400 together with the signal lines G1-Gn and D1-Dm. Other arrangements of parts may also be used in other embodiments.

Referring to FIG. 2, the liquid crystal panel assembly 400 includes a thin film transistor array panel 10 and a common electrode panel 20 facing each other, a liquid crystal layer 15 interposed therebetween, and a spacer (not shown) forming a gap between two panels 10 and 20. In some embodiments, the panels 10 and 20 are compressed.

Referring to one pixel PX of the liquid crystal panel assembly 400, the pixel PX connected to the i-th (i=1−n) gate line Gi and the j-th (j=1−m) data line Dj includes a switching transistor Q, a liquid crystal capacitor Clc, and a sustain capacitor Cst connected thereto.

In this embodiment, the switching transistor Q is a three terminal element such as a thin film transistor, and is located in the thin film transistor array panel 10. the transistor includes a gate electrode connected to the scan line S1, an input terminal connected to the data line D1, and an output terminal connected to the pixel electrode PE of the liquid crystal capacitor Clc. In addition, the thin film transistor may include amorphous silicon or polycrystalline silicon.

The liquid crystal capacitor Clc includes a pixel electrode PE of the thin film transistor array panel 10 and a common electrode CE of the common electrode panel 20. That is, the liquid crystal capacitor Clc has the pixel electrode PE of the thin film transistor array panel 10 and the common electrode CE of the common electrode panel 20 as two terminals, and the liquid crystal layer 15 between the pixel electrode PE and the common electrode CE functions as a dielectric material.

The pixel electrode PE is connected to the switching transistor Q, and the common electrode CE is formed on substantially the entire surface of the common electrode panel 20 and receives a common voltage Vcom. In some embodiments, the common electrode CE is on the thin film transistor array panel 10. In this case, at least one of the two electrodes PE and CE may be made in the form of a line or a bar. The common voltage Vcom is a constant voltage of a predetermined level, and may have a voltage substantially at or near 0V.

The storage capacitor Cst that serves as an auxiliary capacitor to the liquid crystal capacitor Clc is formed as a separate signal line (not shown) on the thin film transistor array panel 10 overlapping the pixel electrode PE with an insulator interposed therebetween. A predetermined voltage such as the common voltage Vcom or the like is applied to the separate signal line.

A color filter CF may be formed on a portion of the common electrode CE of the common electrode panel 20. In order to realize a color display, each pixel PX uniquely displays one of a set of primary colors (spatial division), or each pixel PX temporally and alternately displays one of a set of primary colors (temporal division). Accordingly, the primary colors are spatially or temporally synthesized, and thus a desired color is perceived. An example of the primary colors may be three primary colors of red, green, and blue.

As an example of the spatial division, each pixel PX has a color filter CF that represents one of the primary colors in a region of the common electrode panel 20. Alternatively, the color filter CF may be formed above or below the subpixel electrode PE of the thin film transistor array panel 10.

Referring to FIGS. 3 to 5, the liquid crystal panel assembly 400 has a display area P1 and an edge region P2. The pixels PX and most of the signal lines S1-Sn and D1-Dm are positioned in the display area P1. The common electrode panel 20 includes a light blocking member 22 such as a black matrix, and the light blocking member 22 covers most of the edge region P2, thereby blocking light from the outside.

In this embodiment, the common electrode panel 20 includes a color filter substrate 21, the light blocking member 22 and the color filter CF formed under the color filter substrate 21. In addition, the common electrode panel 20 includes an AC electrode 62 formed under the light blocking member 22, and the common electrode CE formed under the color filter CF. Most of the light blocking member 22 is formed in the edge region P2, and the color filter CF is formed in the display area P1. Most of the common electrode CE is formed in the display area P1.

The thin film transistor array panel 10 includes a thin film transistor array substrate 11, an amorphous silicon gate (ASG) chip 50 mounted on the thin film transistor array substrate 11, a common voltage terminal 51 supplying the common voltage Vcom, a reference electrode 61, and the pixel electrode PE facing the AC electrode 62.

The ASG chip 50 includes the signal controller 100, the scan driver 200, the data driver 300, the gray voltage generator 350, and the AC voltage generator 500 for driving the liquid crystal display (LCD). These driving apparatus 100, 200, 300, 350, and 500 are integrated in the ASG chip 50 such that the mounting area may be reduced and the power consumption may be decreased. Alternatively, one or more of the driving apparatus 100, 200, 300, 350, and 500 or at least one circuit element forming them may be positioned outside the ASG chip 50.

The common electrode panel 20 and the thin film transistor array panel 10 are sealed by a sealant 25 near the edge thereof. The reference electrode 61 and the AC electrode 62 are formed in the edge region P2. The AC electrode 62 may be formed with indium tin oxide (ITO). The reference electrode 61 may be made of ITO, or gold (Au), copper (Cu), aluminum (Al), silver (Ag), indium (In), calcium (Ca), or alloys thereof.

The common voltage terminal 51 is electrically connected to the ASG chip 50, the reference electrode 61, and the common electrode CE to provide the common voltage Vcom.

The reference electrode 61 is applied with a reference voltage such as the common voltage Vcom, and the AC electrode 62 is applied with the AC voltage generated by the AC voltage generator 500.

The AC voltage generator 500 and the AC electrode 62 are connected by short points 63-1 and 63-2. A first AC electrode 62-1 connected to the first short point 63-1 and a second AC electrode 62-2 connected to the second short point 63-2 are electrically isolated from each other and enclose the display area P1.

The common voltage terminal 51 and the common electrode CE are connected to each other by at least one short point 64, and the common electrode CE covers the display area P1.

Now, functionality of the liquid crystal display LCD according to an exemplary embodiment of the present invention is described.

Referring to FIGS. 1 to 5, in some embodiments, the signal controller 100 receives video signals R, G, and B from an external device and input control signals for controlling display of the input video signals. The video signals R, G, and B include luminance information of each pixel PX, and the luminance has a predetermined number of gray levels, for example $1024=2^{10}$, $256=2^{8}$, or $64=2^{6}$. The input control signals may, for example, include a vertical synchronization signal (Vsync), a horizontal synchronization signal Hsync, a main clock signal MCLK, and a data enable signal DE.

The signal controller 100 processes the input video signals R, G, and B for operation of the liquid crystal panel assembly 400 and the data driver 300 based on the input video signals R, G, and B and the input control signals, and generates a scan control signal CONT1 and a data control signal CONT2. The signal controller 100 generates the AC voltage control signal CONT3 based on the threshold temperature. The threshold temperature is the reference temperature for driving the AC voltage generator 500 at the high temperature, and when the peripheral or edge temperature is higher than the threshold temperature, the AC voltage control signal CONT3 is generated in the signal controller 100.

The scan control signal CONT1 is provided to the scan driver 200. The data control signal CONT2 and a processed image data signal DAT are provided to the data driver 300. The AC voltage control signal CONT3 is transmitted to the AC voltage generator 500.

The scan control signal CONT1 includes a scan start signal STV that instructs the start of a scan, and at least one clock signal controlling output of a gate-on voltage Von. The scan control signal CONT1 may further include an output enable signal OE that limits the duration of the gate-on voltage Von.

The data control signal CONT2, for example, includes a horizontal synchronization start signal STH that notifies the transmission start of the image data signal DAT, a load signal LOAD, and a data clock signal HCLK for instruction of application of the data signal to the data lines D1-Dm. The data control signal CONT2 may further include an inversion signal RVS that inverts the polarity of a voltage of the data signal with respect to the common voltage Vcom.

The AC voltage control signal CONT3, for example, includes a first application start signal STVL controlling the application of the AC voltage to the first AC electrode 62-1 and a second application start signal STVR controlling the application of the AC voltage to the second AC electrode 62-2.

The scan driver 200 is connected to the plurality of scan lines S1 to Sn of the liquid crystal panel assembly 400 to apply a scan signal Sout to the plurality of scan lines S1 to Sn. The scan signal is formed of a combination of the gate-on voltage Von that turns on the switching elements Q and a gate-off voltage Voff that that turns off the switching elements Q.

The data driver 300 receives the image data signal DAT, and selects a gray voltage corresponding to the image data signal DAT in the gray voltage generator 350. The data driver 300 applies the selected gray voltage as the data signal to the plurality of data lines D1-Dm. The gray voltage generator 350 may provide a predetermined number of reference gray voltages rather than providing voltages for all the gray levels, and in this case, the data driver 300 may generate gray voltages for all gray levels by dividing the reference gray voltages and selecting a data voltage Vdat corresponding to the data signal.

If the scan driver 200 applies the gate-on voltage Von to the scan line S1 of one pixel row according to the scan control signal CONT1, the switching element Q connected to the scan line S1 is turned on, and the data signal applied to the plurality of data lines D1-Dm is applied to the corresponding pixels PX through the turned-on switching elements Q.

A difference between the data voltage Vdat applied to the pixel PX and the common voltage Vcom is a charge voltage of the liquid crystal capacitor Clc, i.e., a pixel voltage. The electric field is applied to the liquid crystal layer according to the pixel voltage, and the transmittance of light passing through the liquid crystal layer 15 is controlled.

As described above, the data signal is input to the pixel PX.

In repeating the process each horizontal period 1H as controlled by the horizontal synchronization signal Hsync and a data enable signal DE, the gate-on voltage Von is sequentially applied to all the scan lines S1-Sn and the data signal is applied to all the pixels PX such that an image of a frame is displayed.

When one frame is finished, the next frame is started. In each frame, the data driver 300 generates the data voltage according to the inversion signal POL for the polarity of the data voltage applied to each pixel PX such that polarity of the data voltage of the current frame is opposite the polarity of the previous frame. This is referred to as frame inversion. In alternative embodiments, the polarity of the image data signal on one data line may be periodically changed even within one frame according to the inversion signal POL (for example, row inversion and dot inversion), or the polarity of the image data signal applied to one pixel row may also be changed (for example, column inversion and dot inversion).

On the other hand, if the temperature of the liquid crystal display LCD is increased by heat generated by driving the liquid crystal display LCD or by heat from the external environment, the signal controller 100 may transmit the AC voltage control signal CONT3 to the AC voltage generator 500. In response, the AC voltage generator 500 generates the AC voltage according to the AC voltage control signal CONT3 and transmits the AC voltage to the AC electrode 62. The AC voltage generator 500 may increase the amplitude or another characteristic of the AC voltage generated according to the temperature.

For this, the AC voltage generator 500 includes an AC voltage generating circuit for generating the AC voltage according to the temperature and a waveform formation circuit forming and transmitting a waveform of the AC voltage to the two AC electrodes 62-1 and 62-2.

The AC voltage generating circuit and the waveform formation circuit are described.

Figure 6:
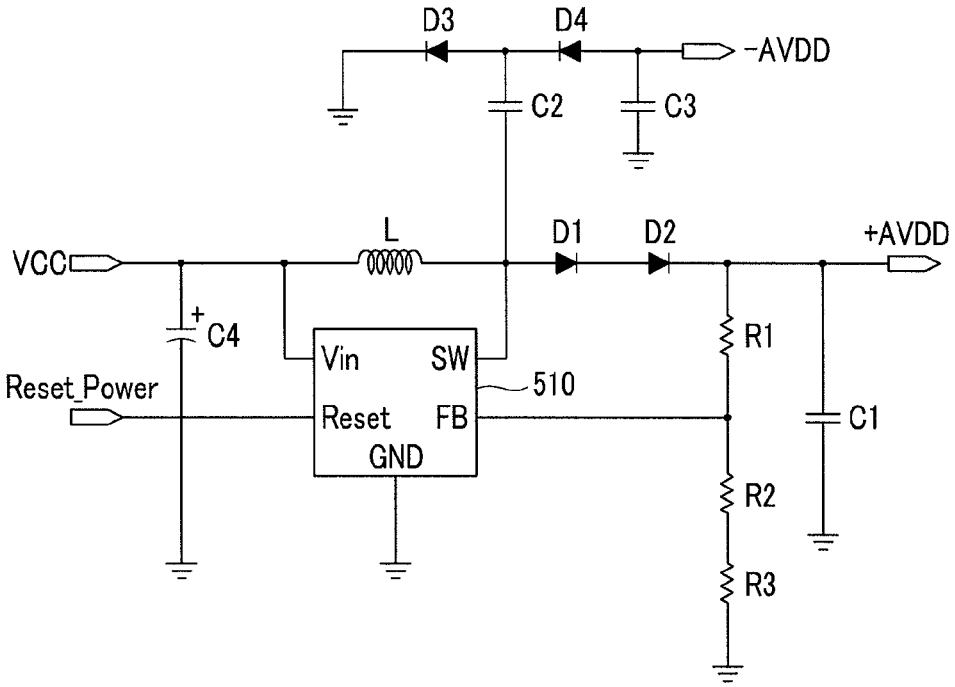
FIG. 6 is a circuit diagram of a circuit generating an AC voltage for a temperature according to an exemplary embodiment.

FIG. 6 is a circuit diagram of a circuit for generating −AVDD and +AVDD voltages for the AC voltage according to temperature according to an exemplary embodiment.

Referring to FIG. 6, the AC voltage generating circuit includes a VCC power source input terminal, an inductor L, a +AVDD voltage output terminal, a −AVDD voltage output terminal, a plurality of diodes D1, D2, D3, and D4, a plurality of capacitors C1, C2, C3, and C4, a plurality of resistors R1, R2, and R3, and a controller 510.

The inductor L includes one terminal connected to the VCC power source input terminal and another terminal is connected to the +AVDD voltage output terminal through diodes D1 and D2. The other terminal of the inductor L is also connected to a switch SW of the controller 510.

The VCC power source input terminal is connected to the fourth capacitor C4. The fourth capacitor C4 includes one terminal connected to the VCC power source input terminal and another terminal that is grounded.

The first diode D1 and the second diode D2 are sequentially connected between the inductor L and the +AVDD voltage output terminal. The first diode D1 includes one terminal connected to the inductor L and another terminal connected to one terminal of the second diode D2, and the second diode D2 includes one terminal connected to the first diode D1 and another terminal connected to the +AVDD voltage output terminal.

The first resistor R1, the second resistor R2, and the third resistor R3 are sequentially connected to the +AVDD voltage output terminal. The first resistor R1 includes one terminal connected to the +AVDD voltage output terminal and another terminal connected to the second resistor R2. The second resistor R2 includes one terminal connected to the first resistor R1 and another terminal connected to the third resistor R3. The resistor R3 includes one terminal connected to the second resistor R2 and another terminal that is grounded. Also, the first and second resistors R1 and R2 are connected to a feedback terminal FB of the controller 510.

The first capacitor C1 includes one terminal connected to the +AVDD voltage output terminal and another terminal that is grounded.

The second capacitor C2 and the fourth diode D4 are sequentially connected between the inductor L and the −AVDD voltage output terminal. The fourth diode D4 includes one terminal connected to the −AVDD voltage output terminal and another terminal connected to the second capacitor C2, and the second capacitor C2 includes one terminal connected to the fourth diode D4 and another terminal connected to the inductor L.

The fourth diode D4 is also connected to one terminal of the third diode D3. The third diode D3 includes one terminal connected to the fourth diode D4 and another terminal that is grounded. The third capacitor C3 includes one terminal connected to the −AVDD voltage output and another terminal that is grounded.

The controller 510 includes an input terminal Vin connected to the VCC power source, the switch SW connected to the inductor L, the feedback terminal FB connected to the +AVDD voltage output terminal through resistor R1, a reset terminal Reset input with a reset power, and a ground terminal GND.

The inductor L suppresses the rapid change of current flowing from the VCC power source input terminal so that more uniform current flows to the +AVDD voltage output terminal. The switch SW of the controller 510 periodically repeats a switching operation and the +AVDD voltage is output to the +AVDD voltage output terminal. The +AVDD voltage is higher than the VCC power source input terminal voltage.

Some current flowing in the inductor L is charged in the second capacitor C2, and the −AVDD voltage is output to the −AVDD voltage output terminal by the charging voltage of the second capacitor C2.

The feedback terminal FB of the controller 510 receives a feedback signal which is dependent on the value of the first resistor R1. The value of the first resistor R1 is dependent on the temperature. As the temperature increases, the value of the resistor is reduced. Accordingly, the feedback signal to the feedback terminal FB of the controller 510 increases as the temperature increases, and decreases as the temperature decreases. In some embodiments the feedback signal is a current.

The controller 510 compares a signal at the input terminal Vin and the feedback signal at the feedback terminal FB to measure the peripheral temperature. The controller 510 controls the switching frequency of the switch SW based on the measured temperature to control the +AVDD voltage and the −AVDD voltage. The controller 510 may increase the difference between the +AVDD voltage and the −AVDD voltage if the temperature increases, and may decrease the difference between the +AVDD voltage and the −AVDD voltage if the temperature decreases.

Figure 7:
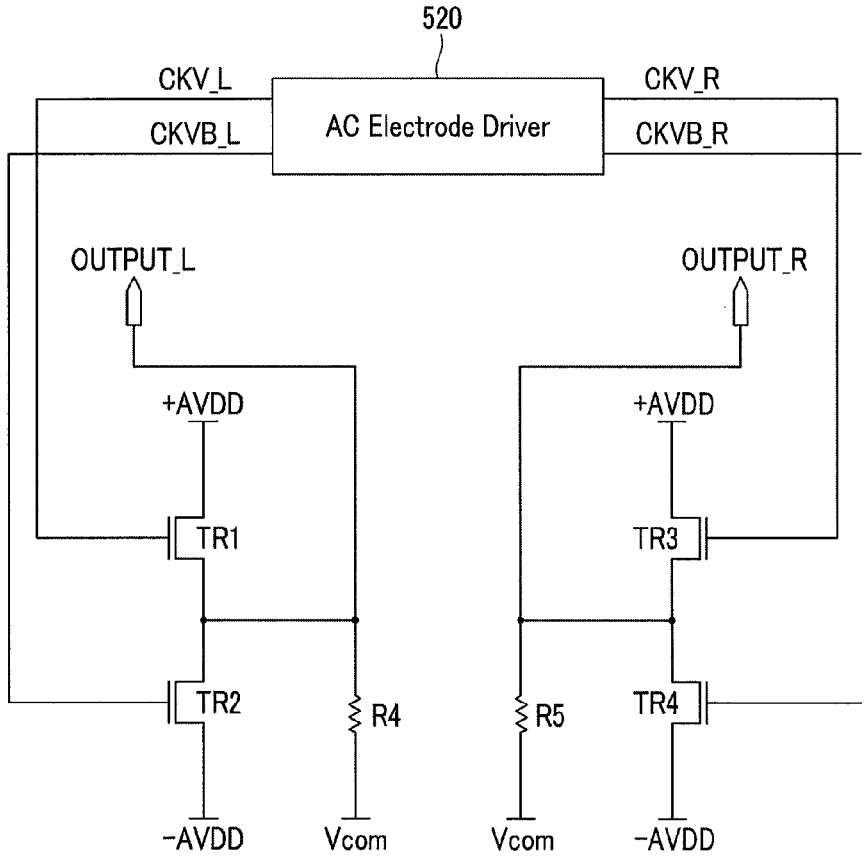
FIG. 7 is a circuit diagram of a circuit forming a waveform of the AC voltage supplied to an edge region of a liquid crystal display (LCD) according to an exemplary embodiment.

FIG. 7 is a circuit diagram of a circuit for generating an AC voltage waveform supplied to an edge region of a liquid crystal display (LCD) according to an exemplary embodiment.

Referring to FIG. 7, the waveform formation circuit generates the AC voltage waveform based on the +AVDD voltage and the −AVDD voltage applies the waveform to the AC electrodes 62-1 and 62-2.

The waveform formation circuit includes a first output terminal OUTPUT_L and a second output terminal OUTPUT_R to apply the AC voltage to the AC electrodes 62-1 and 62-2 with different synchronization or timing.

The waveform formation circuit includes high voltage switching transistors TR1 and TR3 and low voltage switching transistors TR2 and TR4 connected to the output terminals OUTPUT_L and OUTPUT_R, and an AC electrode driver 520 controlling the output of the gate signal of each transistor. A skilled technologist will understand the structure of the circuit 520 based on the functionality described below. The high voltage switching transistors TR1 and TR3 apply the +AVDD voltage to the AC electrodes 62-1 and 62-2, the low voltage switching transistors TR2 and TR4 apply the −AVDD voltage to the AC electrodes 62-1 and 62-2, and the driver 520 transmits the gate signal to the high voltage switching transistors TR1 and TR3 and the low voltage switching transistors TR2 and TR4.

The high voltage switching transistor TR1 connected to the first output terminal OUTPUT_L includes a gate electrode connected to the driver 520, one terminal connected to the +AVDD power source, and another terminal connected to the first output terminal OUTPUT_L. The low voltage switching transistor TR2 connected to the first output terminal OUTPUT_L includes a gate electrode connected to the driver 520, one terminal connected to the −AVDD power source, and another terminal connected to the first output terminal OUTPUT_L. The first output terminal OUTPUT_L is connected to the fourth resistor R4, and the other terminal of the fourth resistor R4 is connected to a conductive line applied with the common voltage Vcom.

The high voltage switching transistor TR3 connected to the second output terminal OUTPUT_R includes a gate electrode connected to the driver 520, one terminal connected to the +AVDD power source, and another terminal connected to the first output terminal OUTPUT_R. The low voltage switching transistor TR4 connected to the second output terminal OUTPUT_R includes a gate electrode connected to the driver 520, one terminal connected to the −AVDD power source, and another terminal connected to the second output terminal OUTPUT_R. The second output terminal OUTPUT_R is connected to one terminal of the fifth resistor R5, and the other terminal of the fifth resistor R5 is connected to the common voltage Vcom.

The driver 520 alternately applies the first gate signal CKV_L for the high voltage switching transistor TR1 and the second gate signal CKVB_L for the low voltage switching transistor TR2. Also, the driver 520 alternately applies the third gate signal CKV_R for the high voltage switching transistor TR3 of the second output terminal OUTPUT_R and the fourth gate signal CKVB_R for the low voltage switching transistor TR4.

If the first gate signal CKV_L is applied, the +AVDD voltage is output to the first output terminal OUTPUT_L, and if the second gate signal CKVB_L is applied, the −AVDD voltage is output to the first output terminal OUTPUT_L. The +AVDD voltage and the −AVDD voltage output to the first output terminal OUTPUT_L are transmitted to the AC electrode 62-1 connected to the first short point 63-1 to form the AC voltage.

If the third gate signal CKV_R is applied, the +AVDD voltage is output to the second output terminal OUTPUT_R, and if the fourth gate signal CKVB_R is applied, the −AVDD voltage is output to the second output terminal OUTPUT_R. The +AVDD voltage and the −AVDD voltage output to the second output terminal OUTPUT_R are transmitted to the AC electrode 62-2 connected to the second short point 63-2 to form the AC voltage.

Figure 8:
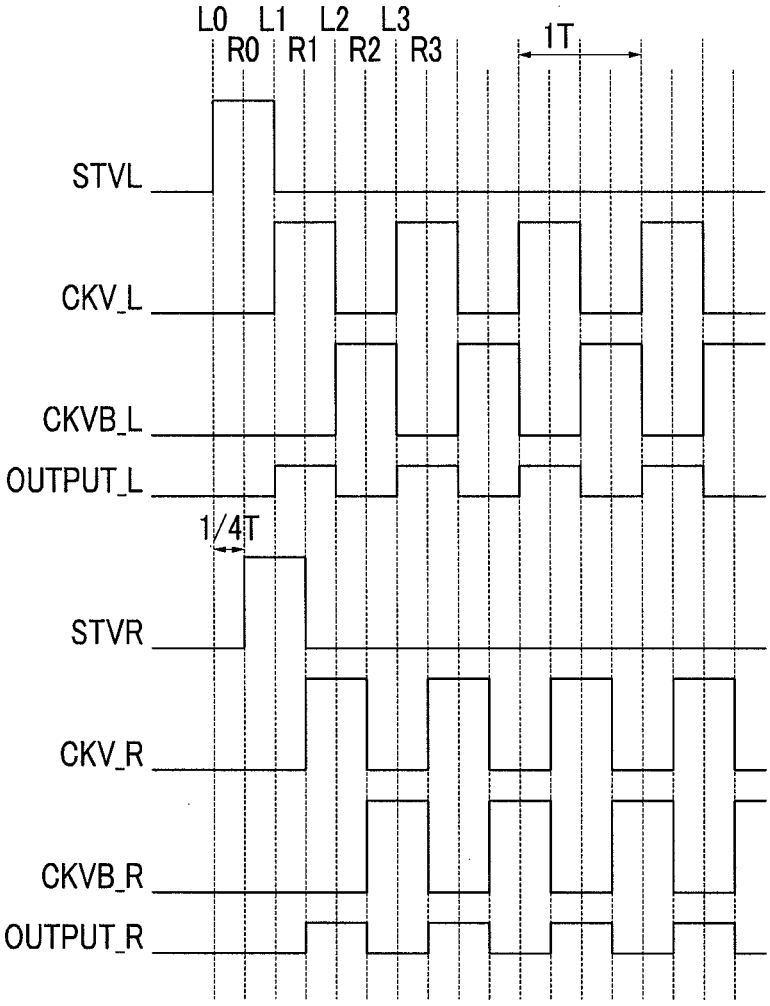
FIG. 8 is a timing diagram showing an operation of a liquid crystal display (LCD) according to an exemplary embodiment.

FIG. 8 is a timing diagram showing functionality of a liquid crystal display (LCD) according to an exemplary embodiment.

Referring to FIG. 8, waveforms are shown which are used to generate the AC voltage at the edge region P2 of the liquid crystal display (LCD) in the AC voltage generator 500.

The signal controller 100 transmits the first application start signal STVL of the AC voltage to the AC voltage generator 500 (L0).

In response, the AC voltage generator 500 applies the first gate signal CKV_L to the gate electrode of the high voltage switching transistor TR1 (L1). The high voltage switching transistor TR1 is turned on, and the +AVDD voltage is applied to the first AC electrode 62-1 through the high voltage switching transistor TR1.

The AC voltage generator 500 disconnects the first gate signal CKV_L and applies the second gate signal CKVB_L to the gate electrode of the low voltage switching transistor TR2 (L2). The low voltage switching transistor TR2 is turned on, and the −AVDD voltage is applied to the first AC electrode 62-1 through the low voltage switching transistor TR2.

The driver 520 may alternately and periodically transmit the first gate signal CKV_L and the second gate signal CKVB_L. That is, the first gate signal CKV_L and the second gate signal CKVB_L are alternately applied as inverted waveforms, and thereby the +AVDD voltage and the −AVDD voltage are periodically changed and output to the first output terminal OUTPUT_L such that the AC voltage is formed in the first AC electrode 62-1.

The period of the first gate signal CKV_L and the second gate signal CKVB_L or the period of the AC voltage is 1 T.

The signal controller 100 may delay the second application start signal STVR compared with the first application start signal STVL, and may transmit the start signal STVR to the AC voltage generator 500 so that the AC voltage of the first AC electrode 62-1 and the AC voltage of the second AC electrode 62-2 have different timing.

In this embodiment, the second application start signal STVR is delayed by ¼T compared with the first application start signal STVL and is transmitted to the AC voltage generator 500 (R0).

The AC voltage generator 500 applies the third gate signal CKV_R to the gate electrode of the high voltage switching transistor TR3 in response to the second application start signal STVL (R1). The high voltage switching transistor TR3 is turned on, and the +AVDD voltage is applied to the second AC electrode 62-2 through the high voltage switching transistor TR3.

The AC voltage generator 500 disconnects the third gate signal CKV_R, and applies the fourth gate signal CKVB_R to the gate electrode of the low voltage switching transistor TR4 (R2). The low voltage switching transistor TR4 is turned on, and the −AVDD voltage is applied to the second AC electrode 62-2 through the low voltage switching transistor TR4.

As described above, the third gate signal CKV_R and the fourth gate signal CKVB_R are alternately applied as inverted waveforms, and thereby the +AVDD voltage and the −AVDD voltage are periodically applied to the second output terminal OUTPUT_R such that the AC voltage is formed in the second AC electrode 62-2.

In this embodiment, the AC voltage of the first AC electrode 62-1 and the AC voltage of the second AC electrode 62-2 have a phase difference of ¼T. The phase difference between the AC voltage of the first AC electrode 62-1 and the AC voltage of the second AC electrode 62-2 may be changed according to the application of the start signal STVL and STVR. For example, phase differences of 0 T, ½T, and ¾T may be used.

The reference electrode 61 facing the AC electrodes 62-1 and 62-2 applied with the AC voltage is applied with a voltage such as common voltage Vcom such that the polarity between the AC electrodes 62-1 and 62-2 and the reference electrode 61 is changed with a period of 1 T.

Accordingly, the ionic particles generated due to the sealant in the high temperature is not attached to the edge of the liquid crystal display (LCD), and therefore the visual artifacts that are formed on the edge of the liquid crystal display (LCD) at the high temperature may be prevented. Also, as the temperature increases, the ionic particles may increase, however the frequency of the AC voltage may be increased according to the increasing temperature such that the attachment of the particles may be prevented.

The drawings referred to hereinabove and the detailed description are presented for illustrative purposes only, and are not intended to limit the scope of the present invention. Those skilled in the art will understand that various modifications and equivalent arrangements of other embodiments are possible.

What is claimed is:

1. A display device, comprising:

a liquid crystal panel assembly including a thin film transistor array panel having a pixel electrode and a common electrode panel having a common electrode applied with a common voltage and divided into a display area having pixels and an edge region enclosing the display area;

an additional, distinct AC electrode formed in the edge region of the common electrode panel and applied with an AC voltage;

an additional, distinct reference electrode formed in the edge region of the thin film transistor array panel opposite the AC electrode and applied with the common voltage;

an AC voltage generator configured to generate the AC voltage and to transmit the AC voltage to the AC electrode; and a signal controller configured to transmit a control signal to the AC voltage generator, wherein the control signal is generated when a temperature of the edge region is higher than a threshold temperature, and wherein the AC voltage generator generates the AC voltage based on the control signal, wherein the AC voltage generator comprises:

an AC voltage generating circuit configured to generate a +AVDD voltage and a −AVDD voltage; and a waveform formation circuit forming an AC waveform comprising the +AVDD voltage and the −AVDD voltage, wherein the waveform formation circuit comprises:

a high voltage switching transistor configured to apply the +AVDD voltage to the AC electrode;

a low voltage switching transistor configured to apply the −AVDD voltage to the AC electrode; and a driver transmitting a gate signal to the high voltage switching transistor and the low voltage switching transistor.

2. The display device of claim 1, wherein the AC voltage generating circuit includes:

an inductor including one terminal connected to a VCC power source and another terminal connected to an output terminal of the +AVDD voltage;

a capacitor including one terminal connected to an output terminal of the −AVDD voltage and another terminal connected to the inductor; and a controller receiving a feedback signal based on the +AVDD voltage and a temperature, wherein the controller is configured to control a voltage level of the +AVDD voltage and the −AVDD voltage according to the measured temperature.

3. The display device of claim 2, wherein the AC voltage generating circuit further comprises:

a resistor including one terminal connected to the inductor and another terminal connected to the controller, wherein the controller senses the temperature based on the current flowing through the resistor and into the controller.

4. The display device of claim 1, wherein the driver alternately applies the gate signal of the high voltage switching transistor and the gate signal of the low voltage switching transistor at a predetermined frequency.

5. The display device of claim 1, wherein the waveform formation circuit further comprises a first output terminal for alternatively outputting the +AVDD voltage and the −AVDD voltage to the AC electrode and a second output terminal for alternatively outputting the +AVDD voltage and the −AVDD voltage.

6. The display device of claim 5, wherein the high voltage switching transistor includes a first high voltage switching transistor connected to the first output terminal and a second high voltage switching transistor connected to the second output terminal.

7. The display device of claim 5, wherein the low voltage switching transistor includes a first low voltage switching transistor connected to the first output terminal and a second low voltage switching transistor connected to the second output terminal.

8. The display device of claim 5, wherein the AC electrode includes a first AC electrode and a second AC electrode that are separated from each other, the AC voltage output from the first output terminal is applied to the first AC electrode, and the AC voltage output from the second output terminal is applied to the second AC electrode.

9. The display device of claim 8, wherein the AC voltage applied to the first AC electrode and the AC voltage applied to the second AC electrode have a phase difference.

10. The display device of claim 8, wherein the control signal includes a first application start signal controlling the application of the AC voltage to the first AC electrode and a second application start signal controlling the application of the AC voltage to the second AC electrode.

11. The display device of claim 10, wherein the first application start signal and the second application start signal are transmitted at different times.

12. The display device of claim 1, wherein the AC electrode is formed of an indium tin oxide (ITO).

13. A method of driving a display device with an AC voltage generator applying an AC voltage to an additional, distinct AC electrode formed in an edge region in a display panel including a display area having pixels and an edge region enclosing the display area, the method comprising:

receiving an application start signal;

in response to the application start signal, applying a first gate signal to a high voltage switching transistor configured to apply a +AVDD voltage to the AC electrode; and applying a second gate signal to a low voltage switching transistor configured to apply a −AVDD voltage to the AC electrode, wherein the AC voltage generator alternately transmits the first gate signal and the second gate signal in a predetermined period, wherein the display panel includes a thin film transistor array panel having a pixel electrode and a common electrode panel having a common electrode applied with a common voltage, wherein the additional, distinct AC electrode formed in the edge region of the common electrode panel, wherein the thin film transistor array panel include an additional, distinct reference electrode formed in the edge region of the think film transistor array panel opposite the AC electrode and applied with the common voltage, and wherein the application start signal includes a first application start signal and a second application start signal transmitted at different times for a first AC electrode and a second AC electrode, respectively, wherein the first AC electrode and the second AC electrode are separated from each other.

14. The method of claim 13, wherein the application start signal of the AC voltage is transmitted to the AC voltage generator when the temperature of the edge region is higher than a threshold temperature.

15. The method of claim 14, wherein the value of the +AVDD voltage and the −AVDD voltage is based on the temperature of the edge region.

16. The method of claim 13, wherein the AC voltage applied to the first AC electrode and the AC voltage applied to the second AC electrode have different phases.

17. The method of claim 13, further comprising applying a second AC voltage to a second AC electrode formed in a second edge region.

* * * * *